United States Patent [19]

Uchtman

[11] Patent Number: 4,903,379

[45] Date of Patent: Feb. 27, 1990

[54] PIN AND CLIP ARRANGEMENT FOR NAME TAGS AND BADGES

[76] Inventor: Charles C. Uchtman, 2604 Sheridan Rd., Evanston, Ill. 60201

[21] Appl. No.: 207,548

[22] Filed: Jun. 16, 1988

[51] Int. Cl.[4] ..... A44B 21/00; A44C 3/00

[52] U.S. Cl. ..... 24/351; 24/67.11; 24/67.7; 40/1.5

[58] Field of Search ..... 24/351, 3 D, 13, 67 R, 24/67.3, 67.5, 67.7, 67.11, 340, 499, 516, 532, 533, 546, 566; 40/1.5

[56] References Cited

U.S. PATENT DOCUMENTS

| | | | |
|---|---|---|---|
| 854,254 | 5/1907 | Summerwell | 24/67.11 |
| 1,443,246 | 1/1923 | Wayton | 24/67.11 |
| 1,851,770 | 3/1932 | Johnson | 24/67.11 X |
| 2,642,841 | 6/1953 | Funk | 24/67.7 X |
| 3,262,223 | 7/1966 | Stoffel | 40/1.5 |
| 3,419,012 | 12/1968 | Stoddard | 24/67.5 X |

FOREIGN PATENT DOCUMENTS

| | | | |
|---|---|---|---|
| 412169 | 11/1945 | Italy | 24/67.5 |

*Primary Examiner*—Laurie K. Cranmer

*Attorney, Agent, or Firm*—Neuman, Williams, Anderson & Olson

[57] ABSTRACT

A releasable grip type fastener which utilizes torsion developed in the gripping member itself to provide gripping force, with the configuration of the gripping member arranged to provide a low profile fastening system with only two parts, a gripping member and a support surface. Conveniently, the fastener may be arranged to incorporate an integral secondary fastener, such as a pin and clasp type, which may be utilized simultaneosuly.

28 Claims, 2 Drawing Sheets

PIN AND CLIP ARRANGEMENT FOR NAME TAGS AND BADGES

BACKGROUND OF THE INVENTION

The present invention relates to fastening systems, and particularly to articles which include fastening systems for releasably gripping other articles.

Common articles which have integral fastening systems with a releasable gripping action include identification tags. Such fastening systems are generally of the well-known "alligator clip" or "binder clip" variety, wherein two jaws are tensioned together by spring force generated by a separate spring or by the spring action of one or both of the jaws themselves.

Alligator clips and binder clips have a number of disadvantages. First of all, they tend to be bulky. They generally require a release lever which protrudes a significant distance from the jaws in order to produce enough torque to release at least one of the jaws. This is why binder clips often include foldable lever handles. Secondly, the gripping torque produced on such clips is applied about an axis resolvable about the joint of at least one of the jaws, so that the longer the jaws are, the more torque is required to maintain the same gripping force on the "teeth", or outer edges, of the jaws. Finally, alligator clips and binder clips usually require a large number of components and assembly time for fabrication.

OBJECTS OF THE INVENTION

Accordingly, one object of the invention is to reduce the size and weight of a releasable grip type of fastening system.

Another object of the invention is to improve the gripping force of a releasable grip type of fastening system without increasing the size of the fastening system.

Yet another object of the invention is to economize and simplify the fabrication of a releasable grip type of fastening system.

A further object of the invention is to arrange a releasable clip fastener which may be integrated with another type of fastener.

SUMMARY OF THE INVENTION

The present invention achieves the above stated objects and other advantages set forth herein by incorporating a unique gripping member in a fastener which operates by creating a torsional force in a movable jaw section of a fastener which forces the jaw against a stationary support surface to which it mounts, thereby gripping an article placed between the jaw and the support surface. The jaw is conveniently fabricated out of a slender torsionable material, such as rod or wire stock, and the entire movable gripping member, including the jaw, may conveniently be fabricated from a continuous length of rod or wire which is bent into the various functional sections of the fastener. Thus, the fastener according to the invention need only have two components, thereby economizing and simplifying the fastener design.

Since the gripping action of the fastener according to the invention is supplied by torsional action within the movable gripping member of the fastener itself, no separate springing is required for the fastener. This feature reduces its size and profile, as well as reducing the cost, the number of components and the assembly time.

The low profile possible with the fastener according to the invention allows it to be arranged in combination with another fastener, such as a pin and clasp type, so that it may be used in applications requiring an article that may or may not need to be pinned in place, such as a name tag.

Further advantages and improvements will be recognized by those skilled in the art in connection with the description of the embodiment described below.

DETAILED DESCRIPTION OF THE EMBODIMENTS

Figure 1:
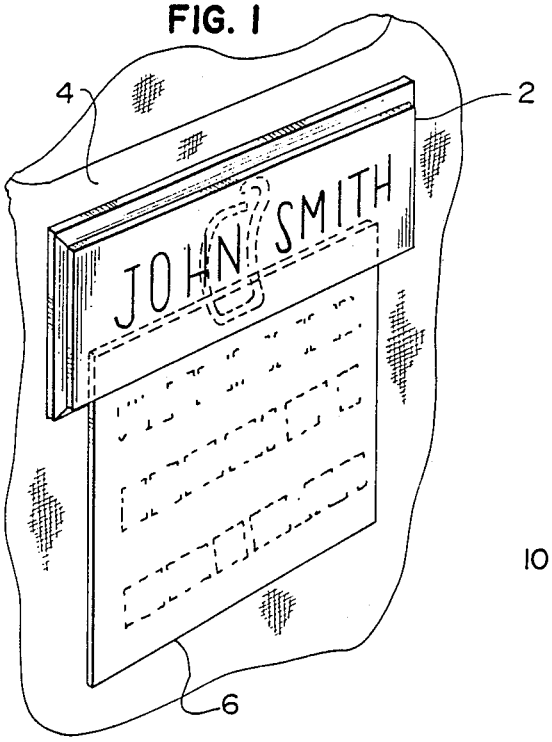
FIG. 1 is a typical application of the fastener according to the invention.

FIG. 1 is a typical application for a fastener which uses a fastening system according to the present invention. A name tag 2 using a fastener according to the present invention is attached to a pocket 4, and an identification tag 6 may be clipped to the name tag 2.

Figure 2:
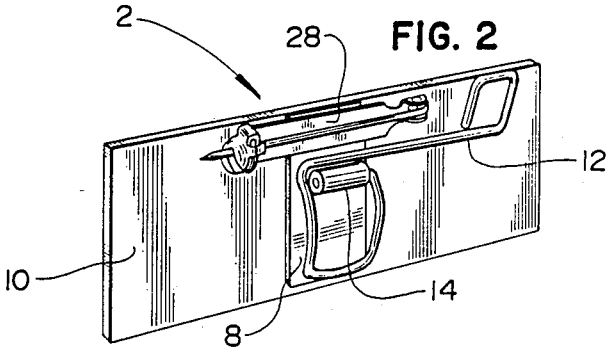
FIG. 2 is a fastener using one embodiment of a fastening system according to the present invention which incorporates an integral secondary fastening system.

The name tag 2, incorporating a preferred embodiment of the invention, is shown in detail in FIG. 2. It includes a support surface 8, which may conveniently be mounted to a mounting surface 10 of the fastener 2. A gripping member 12 is connected to the support surface 8 with a surface mount 14. Although the gripping member is shown as a continuous length of a rod or rod-like material, such as wire, which is bent to provide the required configuration, the gripping member 12 can comprise an assembly of separate components which are connected together to achieve the same general configuration. Although the surface mount 14 is shown as a cylindrical tube to mate with a corresponding section of the gripping member 12, the surface mount 14 could have a number of other configurations, such as a folded tongue protruding from the support surface 8, or a socket for swiveling joint, if rotation of the gripping member about the surface mount 8 is desirable.

Figure 3:
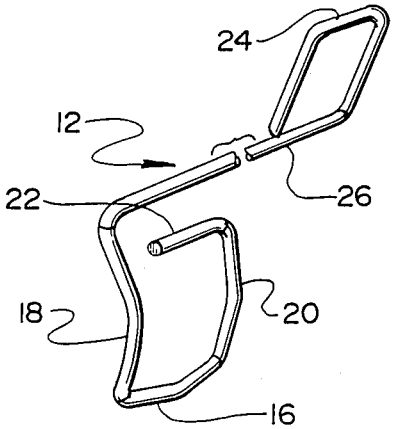
FIG. 3 is the gripping member used in the fastener of FIG. 2.

The gripping member 12 is shown in detail in FIG. 3, and the various parts of the gripping member 12 will be considered with reference to FIG. 3 and FIG. 2 together. The gripping member 12 includes a gripping section 16, which is generally a longitudinal, rod-like section of the gripping member 12 which can be axially torsioned from its ends. Although shown as one section of a continuous length of rod or wire, it may in fact conveniently be a separate shaft section.

Figure 5:
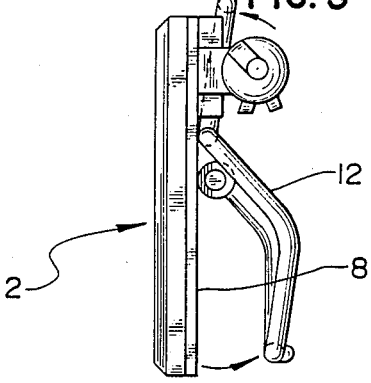
FIG. 5 is an end view of the fastener of FIG. 2 shown in the open, or releasing position.
Figure 4:
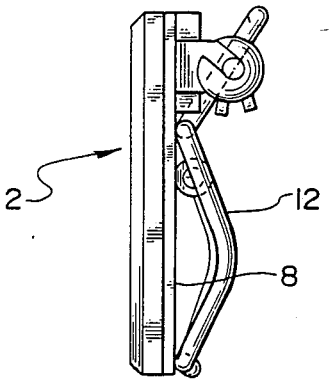
FIG. 4 is an end view of the fastener of FIG. 2 shown in the closed, or gripping position.

A first torsioning arm section 18 extends substantially radially from one end of the gripping section 16. As may be seen in FIG. 2, the far end of the first arm section is braced upon the support surface 8 when the gripping member 12 is attached to the support surface 8. FIGS. 4 and 5 show an end view of the name tag with the gripping member 12 shown in the closed and open positions, respectively. It may be seen in FIGS. 3 and 4 how the far end of the first arm section remains in contact with the support surface 8 as the gripping member 12 opens and closes. Although the first arm section 18 is shown as one section of a continuous length of rod or wire, it may in fact conveniently be a separate rigid lever.

A second torsioning arm section 20 extends substantially radially from the end of the gripping section 16 opposite the end connecting with the first arm section 18. Its radial position on the gripping section 16, as shown in FIG. 5, is displaced relative to the radial position of the first arm section 18.

The difference in radial positions of the first arm section 18 and the second arm section 20 is to exert a torsional effect on the gripping section 16 which forces the gripping section 16 downward toward the support surface 8 when the second arm section 20 is rotated toward the support surface 8. This torsional effect on the gripping section 16 serves to grip an article placed between it and the support surface 8. Although the second arm section 20 is shown as one section of a continuous length of rod or wire, it may in fact conveniently be a separate rigid lever.

To hold the end of the second arm section 20 in place near the support surface 8, as well as to act as a means for retaining the gripping member 12 to the support surface 8, a pivot section 22 extends from the end of the second arm section 20 opposite the gripping section 16. It extends toward said first arm section 18, substantially parallel to said gripping section 16, and it has a circular cross section which allows it to be mounted and rotated within the surface mount 14. Although the pivot section 22 is shown as one section of a continuous length of rod or wire, it may in fact conveniently be a separate circular rod or wire section. Alternatively, depending on requirements, the pivot section 22 could have another configuration, such as a ball, to fit into a mating surface mount 14 configuration, such as a socket, which could be used to allow the gripping member 12 to rotate about the support surface 8.

A release lever section 24 is coupled to the end of the first arm section 18 opposite the gripping member 16. The release lever section 24 may conveniently be coupled to the first arm section 18 with a support section 26. The support section 26 extends from the end of the first arm section 18 toward the second arm section 20, substantially parallel to the gripping section 16.

The support section 26 serves to extend the position of the release lever section 24 relative to the gripping section 16 as well as to provide additional support for the gripping member 12 on the support surface 8 as it is opened and closed.

In any case, the release lever section 24 has a plane of rotation about the support surface 8 which is substantially parallel to the plane of rotation of said first arm section 18 about the support surface 8. The radial position of the release lever 24 is selected so that rotation of the release lever section 24 toward the support surface 8 causes the gripping member to assume its open position, as shown in FIG. 5. The release lever 24 is operated with sufficient force to overcome the force exerted by the gripping member 12 towards the support surface 8. Of course, the release lever may assume a variety of configurations, such as a simple straight rod, a paddle of any shape, or a loop of any configuration. Although the release lever 24 and the support sections 26 are shown as sections of a continuous length of rod or wire, the release lever may in fact be any sort of rigid lever, and the support section 26 may be any sort of coupling shaft.

The fastener according to the invention is easily arranged to permit the incorporation as a secondary fastening device, such as a pin and clasp fastener 28. The compact profile of the fastener according to the invention permits both fastening systems to be utilized simultaneously such as shown in FIG. 1. The pin and clasp fastener may be conveniently mounted to the support surface 8 using a variety of means, such as by soldering, riveting, gluing, or forming a folded tongue around an edge of the support surface 8 into which one side of the pin and clasp fastener 28 may be inserted, as shown in FIG. 2. The pin and clasp fastener may also be an integral part of the support surface 8. The end of the folded tongue formed in the support surface 8 may conveniently engage a ridge in the pin and clasp fastener 28 to hold the fastener 28 in place.

Figure 6:
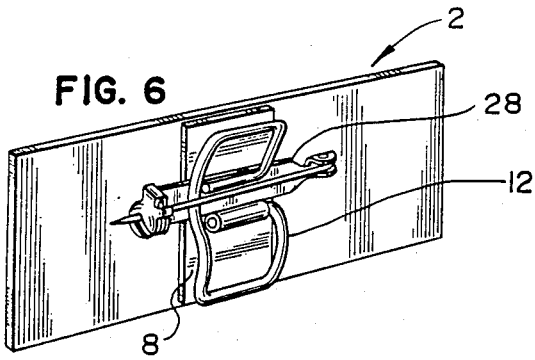
FIG. 6 is a first alternate embodiment of the invention with a secondary fastening system.
Figure 7:
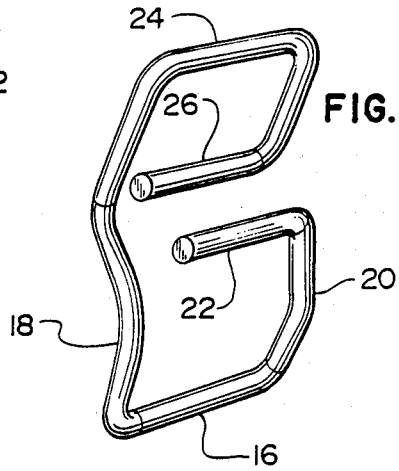
FIG. 7 is the gripping member used in the first alternate embodiment of FIG. 6.

FIG. 6 and FIG. 7 show a first alternate embodiment of the invention, wherein the release lever 24 and the support section 26 are interchanged, relative to the embodiment shown in FIG. 2. This configuration may be desirable when the release lever 24 is more suitably located immediately proximate the first arm section 18. The operation of the first alternative embodiment of FIG. 6 is otherwise the same as described for the preferred embodiment above.

When the first alternate embodiment is utilized, it may be more convenient to mount the pin fastener 28 directly under the release lever 24 and support section 26, as shown, so as to minimize interference with the rotation of the release lever 24.

Figure 8:
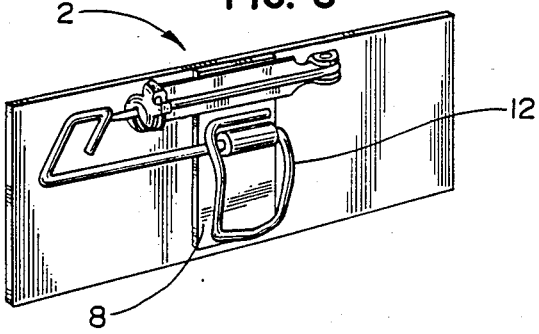
FIG. 8 is a second alternate embodiment of the invention with a secondary fastening system.
Figure 9:
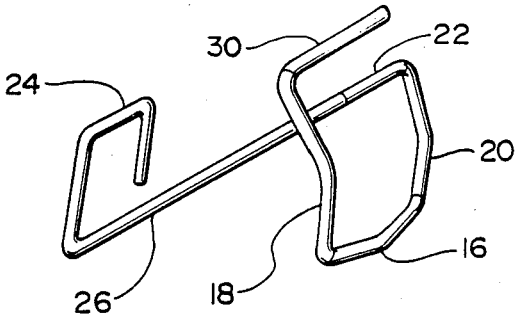
FIG. 9 is the gripping member used in the second alternate embodiment of FIG. 8.

FIG. 8 and FIG. 9 show a second alternate embodiment of the invention, wherein the release lever 24 and the support section 26 are connected to the pivot section 22, relative to the embodiment shown in FIG. 2. It is convenient, but not necessary, to add an additional support section 30 to the support surface braced end of the first arm section 18, as shown, to provide additional bracing.

Of course, the first arm section 18 and the second arm section 20 may conveniently be interchanged in position on the ends of gripping section 16 in all of the above described and illustrated embodiments to reposition the release lever 24 as required for any particular application. Likewise, although a prior type fastener is shown in all of the combination fastening system embodiments described and illustrated above, such a pin and clasp type fastener may be deleted, or substituted with another type of fastener.

It will be understood that various changes in the details and materials, and the arrangements and configurations of parts which have been herein described and illustrated in order to explain the nature of the invention may be made by those skilled in the art within the principle and scope of the invention as expressed in the appended claims.

What is claimed is:

1. As part of a fastening system on a first article for fastening at least a second article, a releasable grip fastener comprising:

a substantially planar support surface; and a gripping member mounted to said support surface, said gripping member comprising:

a torsionable gripping shaft arranged substantially parallel to said support surface, for gripping said second article between said support surface and said gripping member;

a first torsioning arm means, for biasing said gripping shaft, a first end of said first torsioning arm means attached to a first end of said gripping shaft and extending substantially radially away from said gripping shaft, and a second end of said first torsioning arm means braced against said support surface;

a second torsioning arm means for torsioning said gripping shaft, having a length shorter than said first arm, a first end of said second torsioning arm means attached to a second end of said gripping shaft and extending substantially radially from said gripping shaft, with a second end of said second torsioning arm means rotatably engaged with said support surface to allow rotation of said gripping shaft away from said support surface transversely to its length, and said second torsioning arm means attached at a radial position on said gripping shaft for causing torsion in said gripping shaft which forces said gripping shaft toward said support surface to engage said second article; and a release lever for releasing said second article, mounted to said second end of said first torsioning arm means, extending away from said support surface and said first arm, such that rotation of said release lever toward said support surface forces said gripping shaft away from said support surface to release said second article.

2. The fastener recited in claim 1, wherein said release lever includes a support shaft for supporting and extending said release lever, said support shaft extending away from said first torsioning arm means from said second end of said first arm means, along said support surface and parallel with said gripping shaft.

3. The fastener recited in claim 2, wherein said second end of said second arm means includes a pivot shaft arranged with its length parallel to the length of said gripping shaft, and said support surface includes a receptacle for said pivot shaft to allow rotation of said pivot shaft on said support surface.

4. The fastener recited in claim 3, wherein said receptacle comprises a sleeve bearing mounted on said support surface.

5. The fastener recited in claim 4, wherein said gripping member comprises a continuous length of bent wire.

6. The fastener recited in claim 5, wherein said gripping shaft and said first and second torsioning arm means are bowed sections with their respective radii of curvature arranged away from said support surface.

7. The fastener recited in claim 6, wherein said release lever is arranged to extend both axially and radially from said support shaft.

8. The fastener recited in claim 7, including a secondary pin type fastener for fastening a third article, said pin fastener mounted on said support surface to said gripping member.

9. A fastener mounted on a first article for releasably gripping at least a second article, comprising:

a substantially planar support surface;

a cylindrical surface mounting; and a gripping member comprising a continuous length of bent wire, including bent wire sections comprising:

a torsionable gripping section arranged substantially parallel to said support surface for gripping said second article between said support surface and said gripping member;

a first torsioning arm section means, for biasing said gripping section, bent from a first end of said gripping section and extending substantially radially away from said gripping section, with an end of said first arm section means biased against said support surface;

a second torsioning arm section means, for torsioning said gripping section, having a length shorter than said first arm section means, bent from a second end of said gripping section and extending substantially radially from said gripping section away from said support surface such that rotation of said second arm section means toward said support surface causes torsion in said gripping section which forces said gripping member toward said support surface to engage said second article;

a pivot section, for retaining said second arm section means, bent from an end of said second arm section means, extending toward said first arm section means parallel to said gripping section, said pivot section engaged in said cylindrical surface mounting to hold said gripping member in place and to keep torsion on said gripping section; and a release lever section, for releasing said second article, bent from the end of said first arm section means, extending away from said support surface and said first arm section means, such that rotation of said release lever section toward said support surface forces said gripping section away from said support surface to release said second article.

10. The fastener recited in claim 9, wherein said release lever section includes a support section, for supporting and extending said release lever section, which comprises a bent section of said release lever section which extends along said support surface parallel with said gripping shaft.

11. The fastener recited in claim 10, wherein said gripping section, first arm section means, and second arm section means are bowed, with their respective radii of curvature arranged away from said support surface.

12. The fastener recited in claim 9, wherein said release lever section is bent to extend both axially and radially from said support section.

13. The fastener recited in claim 12, including a secondary pin and clasp type fastener for fastening a third article, said pin and clasp fastener mounted on said support surface adjacent to said gripping member.

14. As part of a fastening system on a first article for fastening at least a second article, a releasable grip fastener comprising:

a substantially planar support surface; and a gripping member mounted to said support surface, said gripping member comprising:

a torsionable gripping shaft arranged substantially parallel to said support surface, for gripping said second article between said support surface and said gripping member;

a first torsioning arm means, for biasing said gripping shaft, a first end of said first torsioning arm means attached to a first end of said gripping shaft and extending substantially radially away from said gripping shaft, and a second end of said first torsioning arm means, braced against said support surface;

a second torsioning arm means, for torsioning said gripping shaft, having a length shorter than said first arm means, a first end of said second torsioning arm means attached to a second end of said gripping shaft and extending substantially radially from said gripping shaft, with a second end of said second torsioning arm means rotatably engaged with said support surface to allow rotation of said gripping shaft away from said support surface transversely to its length, and said second torsioning arm means attached at a radial position on said gripping shaft to cause torsion in said gripping shaft which forces said gripping shaft toward said support surface to engage said second article; and a release lever for releasing said second article, mounted to said second end of said second arm means extending away from said support surface and said second arm means, such that rotation of said release lever toward said support surface forces said gripping shaft away from said support surface to release said second article.

15. The fastener recited in claim 14, wherein said first arm means includes a first support shaft, for additional biasing, extending toward said second arm means from said support surface braced end of said first arm means along said support surface.

16. The fastener recited in claim 15, wherein said release lever includes a second support shaft for supporting and extending said release lever, said second support shaft extending away from said second arm means from said second end of said second arm means, along said support surface and parallel with said gripping shaft.

17. The fastener recited in claim 16, wherein said second end of said second arm means includes a pivot shaft arranged with its length parallel to the length of said gripping shaft, and said support surface includes a receptacle for said pivot shaft to allow rotation of said pivot shaft on said support surface.

18. The fastener recited in claim 17, wherein said receptacle comprises a sleeve bearing mounted on said support surface.

19. The fastener recited in claim 18, wherein said gripping member comprises a continuous length of bent wire.

20. The fastener recited in claim 19, wherein said gripping shaft and said first and second torsioning arm means are bowed sections with their respective radii of curvature arranged away from said support surface.

21. The fastener recited in claim 20, wherein said release lever is arranged to extend both axially and radially from said support shaft.

22. The fastener recited in claim 21, including a secondary fastener for fastening a third article, said secondary fastener mounted on said support surface adjacent to said gripping member.

23. A fastener mounted on a first article for releasably gripping at least a second article, comprising:

a substantially planar support surface;

a cylindrical surface mounting; and a gripping member comprising a continuous length of bent wire, including bent wire sections comprising:

a torsionable gripping section arranged substantially parallel to said support surface for gripping said second article between said support surface and said gripping member;

a first torsioning arm section means, for biasing said gripping section, bent from a first end of said gripping section and extending substantially radially away from said gripping section, with an end of said first arm section means braced against said support surface;

a second torsioning arm section means, for torsioning said gripping section, having a length shorter than said first arm section means, bent from a second end of said gripping section and extending substantially radially from said gripping section away from said support surface such that rotation of said second arm section means toward said support surface causes torsion in said gripping section which forces said gripping member toward said support surface to engage said second article;

a pivot section, for retaining said second arm section means, bent from an end of said second arm section means, extending toward said first arm section means parallel to said gripping section, said pivot section engaged in said cylindrical surface mounting to hold said gripping member in place and to keep torsion on said gripping section; and a release lever section, for releasing said second article, bent from the end of said second arm section means, extending away from said support surface and said second arm section means such that rotation of said release lever section toward said support surface forces said gripping section away from said support surface to release said second article.

24. The fastener recited in claim 23, wherein said first arm section means includes a first support section, for additional bracing, bent from the end of said first arm section means and extending toward said second arm section means along said support surface.

25. The fastener recited in claim 24, wherein said release lever section includes a second support section, for supporting and extending said release lever section, which comprises a bent section of said release lever section which extends along said support surface parallel with said gripping section.

26. The fastener recited in claim 25, wherein said gripping section, first arm section means and second arm section means are bowed, with their respective radii of curvature arranged away from said support surface.

27. The fastener recited in claim 26, wherein said release lever section is bent to extend both axially and radially from said support section.

28. The fastener recited in claim 27, including a secondary pin and clasp type fastener for fastening a third article, said pin and clasp fastener mounted on said support surface adjacent to said gripping member.

* * * * *